US008220658B2

(12) United States Patent
Cora et al.

(10) Patent No.: US 8,220,658 B2
(45) Date of Patent: Jul. 17, 2012

(54) DEVICE AND METHOD FOR EVAPORATING WATER FROM A COMPRESSOR

(75) Inventors: Jason Cora, Raleigh, NC (US); Matthew P. Daniels, Pittsboro, NC (US)

(73) Assignee: Parata Systems, LLC, Durham, NC (US)

( * ) Notice: Subject to any disclaimer, the term of this patent is extended or adjusted under 35 U.S.C. 154(b) by 0 days.

(21) Appl. No.: 13/368,684

(22) Filed: Feb. 8, 2012

(65) Prior Publication Data

US 2012/0131883 A1 May 31, 2012

Related U.S. Application Data

(62) Division of application No. 12/199,989, filed on Aug. 28, 2008, now Pat. No. 8,113,492.

(60) Provisional application No. 61/018,980, filed on Jan. 4, 2008.

(51) Int. Cl.
*G07F 11/00* (2006.01)

(52) U.S. Cl. ..... 221/13; 221/9; 221/208; 221/277; 221/278; 62/115; 261/109; 261/119.1

(58) Field of Classification Search ..... 261/109, 261/119.1; 62/115; 221/9, 13, 208, 277, 221/278

See application file for complete search history.

(56) References Cited

U.S. PATENT DOCUMENTS

| | | | | |
|---|---|---|---|---|
| 2,145,776 | A | 1/1939 | Muffly | |
| 2,598,037 | A | 5/1952 | Owenby | |
| 3,096,630 | A | 7/1963 | Weller | |
| 3,595,299 | A | 7/1971 | Weishaupt et al. | |
| 3,907,679 | A | 9/1975 | Yost | |
| 5,337,919 | A * | 8/1994 | Spaulding et al. | 221/2 |
| 5,341,854 | A * | 8/1994 | Zezulka et al. | 141/1 |
| 6,006,946 | A * | 12/1999 | Williams et al. | 221/9 |
| 6,036,812 | A * | 3/2000 | Williams et al. | 156/277 |

(Continued)

FOREIGN PATENT DOCUMENTS

| | | |
|---|---|---|
| GB | 1460450 | 1/1977 |

(Continued)

OTHER PUBLICATIONS

International Search Report and Written Opinion for corresponding PCT Application No. PCT/US2008/013706, Date of mailing Jan. 24, 2009.

*Primary Examiner* — Robert J Hill, Jr.

*Assistant Examiner* — Christopher P Jones

(74) *Attorney, Agent, or Firm* — Myers Bigel Sibley & Sajovec

(57) ABSTRACT

A system for evaporating excess water from a source includes a housing having: an air inlet, the air inlet directing air in a first direction; an air outlet; a plurality of channels arranged generally perpendicular to the first direction, the channels having undulations; and a water reservoir that feeds water into the channels. In some embodiments, baffles are created with walls that depend from the ceiling of the housing and that are interdigitated with dividers that separate the channels. This configuration can remove water generated by the source (such as an external compressor unit) in a quick and efficient manner.

16 Claims, 8 Drawing Sheets

U.S. PATENT DOCUMENTS

| | | | | |
|---|---|---|---|---|
| 6,176,392 | B1 * | 1/2001 | William et al. | 221/109 |
| 6,593,525 | B1 | 7/2003 | Vanderhoof et al. | |
| 6,971,541 | B2 | 12/2005 | Williams et al. | |
| 7,006,893 | B2 | 2/2006 | Hart et al. | |
| 7,097,068 | B2 * | 8/2006 | Limback et al. | 221/2 |
| 7,949,427 | B2 * | 5/2011 | Michelli et al. | 700/236 |
| 2002/0179295 | A1 | 12/2002 | Palanchon | |
| 2003/0216831 | A1 * | 11/2003 | Hart et al. | 700/235 |
| 2005/0109497 | A1 | 5/2005 | Cieslik et al. | |
| 2008/0283540 | A1 * | 11/2008 | Kulberg et al. | 221/3 |
| 2009/0294464 | A1 * | 12/2009 | Michelli et al. | 221/1 |
| 2010/0318218 | A1 * | 12/2010 | Muncy et al. | 700/220 |
| 2011/0248042 | A1 * | 10/2011 | Kulberg et al. | 221/1 |
| 2012/0016519 | A1 * | 1/2012 | Rivenbark, Jr. | 700/244 |

FOREIGN PATENT DOCUMENTS

| | | |
|---|---|---|
| JP | 7019168 | 1/1995 |
| JP | 8312535 | 11/1996 |
| JP | 2003301776 | 10/2003 |
| JP | 2004012092 | 1/2004 |
| JP | 2004239487 | 8/2004 |
| JP | 2005009779 | 1/2005 |
| JP | 2007292319 | 8/2007 |

* cited by examiner

DEVICE AND METHOD FOR EVAPORATING WATER FROM A COMPRESSOR

RELATED APPLICATIONS

This application is a divisional of U.S. patent application Ser. No. 12/199,989, filed Aug. 28, 2008, now U.S. Pat. No. 8,113,492, issued Feb. 14, 2012, which claims priority from U.S. Provisional Patent Application No. 61/018,980, filed Jan. 4, 2008 and entitled Device and Method for Evaporating Water from Compressor in Automated Pharmacy Machine, the disclosure of which is hereby incorporated by reference herein in its entirety.

FIELD OF THE INVENTION

The present invention is directed generally to the dispensing of prescriptions of pharmaceuticals, and more specifically is directed to the automated dispensing of pharmaceuticals.

BACKGROUND OF THE INVENTION

Pharmacy generally began with the compounding of medicines, which entailed the actual mixing and preparing of medications. Heretofore, pharmacy has been, to a great extent, a profession of dispensing, that is, the pouring, counting, and labeling of a prescription, and subsequently transferring the dispensed medication to the patient. Because of the repetitiveness of many of the pharmacist's tasks, automation of these tasks has been desirable.

Some attempts have been made to automate the pharmacy environment. Different exemplary approaches are shown in U.S. Pat. No. 5,337,919 to Spaulding et al. and U.S. Pat. Nos. 6,006,946; 6,036,812 and 6,176,392 to Williams et al. The Williams system conveys a bin with tablets to a counter and a vial to the counter. The counter dispenses tablets to the vial. Once the tablets have been dispensed, the system returns the bin to its original location and conveys the vial to an output device. Tablets may be counted and dispensed with any number of counting devices. Drawbacks to these systems typically include the relatively low speed at which prescriptions are filled and the absence in these systems of securing a closure (i.e., a lid) on the container after it is filled.

One additional automated system for dispensing pharmaceuticals is described in some detail in U.S. Pat. No. 6,971,541 to Williams et al. This system has the capacity to select an appropriate vial, label the vial, fill the vial with a desired quantity of a selected pharmaceutical tablet, apply a cap to the filled vial, and convey the labeled, filled, capped vial to an offloading station for retrieval. The system discussed therein employs forced air that agitates tablets within a bin. The agitated tablets are conveyed via suction in singulated fashion through an outlet into the vial.

The Williams system includes a compressor that provides the forced air to agitate the tablets and to create the suction that induces the tablets through the outlet. The process of compressing air forces water vapor to liquefy in the compressed air stream. This liquid is separated from the pressurized air and periodically dispelled. Operators must then remove the water manually. It would be desirable to provide a system that addresses the presence of condensation from the compressor.

SUMMARY OF THE INVENTION

As a first aspect, embodiments of the present invention are directed to a system for evaporating excess water from a source. The system comprises a housing having: an air inlet, the air inlet directing air in a first direction; an air outlet; a plurality of channels arranged generally perpendicular to the first direction, the channels having undulations; and a water reservoir that feeds water into the channels. In some embodiments, baffles are created with walls that depend from the ceiling of the housing and that are interdigitated with dividers that separate the channels. This configuration can remove water generated by the source (such as an external compressor) in a quick and efficient manner.

As a second aspect, embodiments of the present invention are directed to a system for evaporating excess water generated by a compressor unit. The system comprises a housing having an air inlet, the air inlet directing air in a first direction, an air outlet, a plurality of channels, and a water reservoir that feeds water into the channels. The system further comprises a compressor unit that generates air and water, the water being extracted from pressurized air produced by the compressor unit. The compressor unit is fluidly connected with the air inlet to supply ambient air thereto and fluidly connected to the water reservoir to provide water thereto.

As a third aspect, embodiments of the present invention are directed to an automated pharmacy machine. The automated pharmacy machine comprises: a container dispensing station; a container labeling station; a tablet dispensing station, the tablet dispensing station being configured to utilize compressed air provided by a compressor unit; a capping station; a carrier configured to move a container between the container dispensing station, the container labeling station, the tablet dispensing station, and the capping station; and an evaporation system. The evaporation system is configured to receive ambient air and water from the compressor unit, the water being extracted from pressurized air produced by the compressor unit, and to evaporate the water utilizing the ambient air.

As a fourth aspect, embodiments of the present invention are directed to a method of evaporating water generated by a compressor unit. The method includes the steps of: pressurizing air with the compressor unit; extracting water from the pressurized air; passing the extracted water into an evaporation system; passing ambient air generated by the compressor unit into the evaporation system at a rate sufficient to evaporate the water.

DETAILED DESCRIPTION OF EMBODIMENTS OF THE INVENTION

Figure 1:
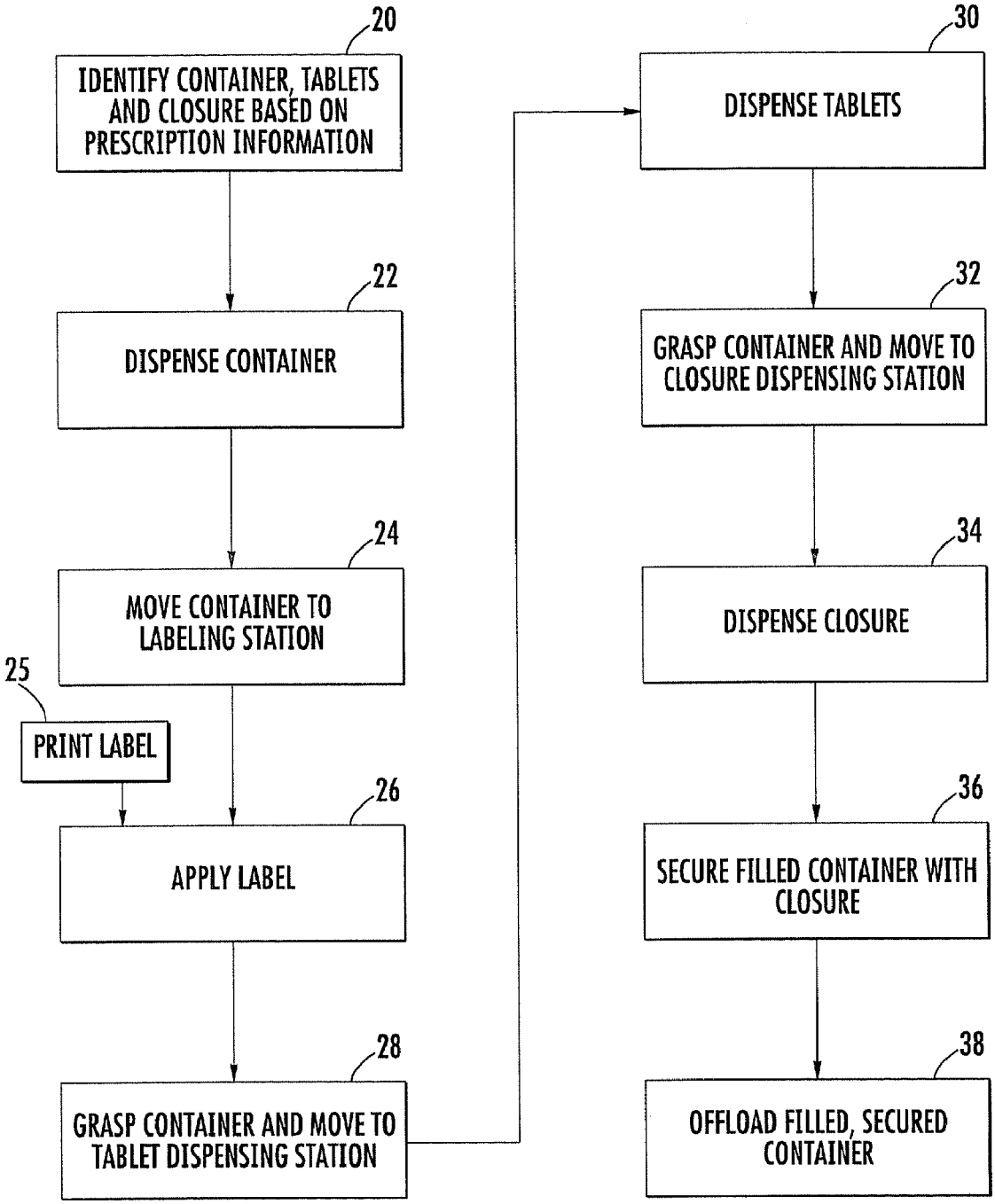
FIG. 1 is a flow chart depicting operations that can be carried out by an automated pharmacy machine according to embodiments of the present invention.

The present invention will now be described more fully hereinafter, in which preferred embodiments of the invention are shown. This invention may, however, be embodied in different forms and should not be construed as limited to the embodiments set forth herein. Rather, these embodiments are provided so that this disclosure will be thorough and complete, and will fully convey the scope of the invention to those skilled in the art. In the drawings, like numbers refer to like elements throughout. Thicknesses and dimensions of some components may be exaggerated for clarity.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein the expression "and/or" includes any and all combinations of one or more of the associated listed items.

In addition, spatially relative terms, such as "under", "below", "lower", "over", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "under" or "beneath" other elements or features would then be oriented "over" the other elements or features. Thus, the exemplary term "under" can encompass both an orientation of over and under. The device may be otherwise oriented (rotated 90 degrees or at other orientations) and the spatially relative descriptors used herein interpreted accordingly.

Also, as used herein, the terms "downstream" and "upstream," which are often used in manufacturing environments to indicate that certain material being acted upon is farther along in the manufacturing process than other material, are intended to indicate relative positions of components along a path followed by a substantially continuous material flow that travels along and through the components. A component that is "downstream" from another component means that the first component is positioned farther along the path, and a component that is "upstream" from another component means that the first component is nearer the origin of the path. It should be noted that, relative to an absolute x-y-z coordinate axis system, these directions shift as the material is conveyed between different operations. When they occur, these shifts in absolute direction are noted hereinbelow, and the downstream direction is redefined with reference to structures illustrated in the drawings.

Well-known functions or constructions may not be described in detail for brevity and/or clarity.

As described above, the invention relates generally to a system and process for dispensing pharmaceuticals. An exemplary process is described generally with reference to FIG. 1. The process begins with the identification of the proper container, tablets or capsules and closure to be dispensed based on a patient's prescription information (Box 20). A container of the proper size is dispensed at a container dispensing station (Box 22), then moved to a labeling station (Box 24). A printing station prints a label (Box 25) that is applied at the labeling station (Box 26), after which the container is transferred to a tablet dispensing station (Box 28), from which the designated tablets are dispensed in the designated amount into the container (Box 30). The filled container is then moved to a closure dispensing station (Box 32), where a closure of the proper size has been dispensed (Box 34). The filled container is secured with a closure (Box 36), then transported to an offload station and offloaded (Box 38).

Figure 2:
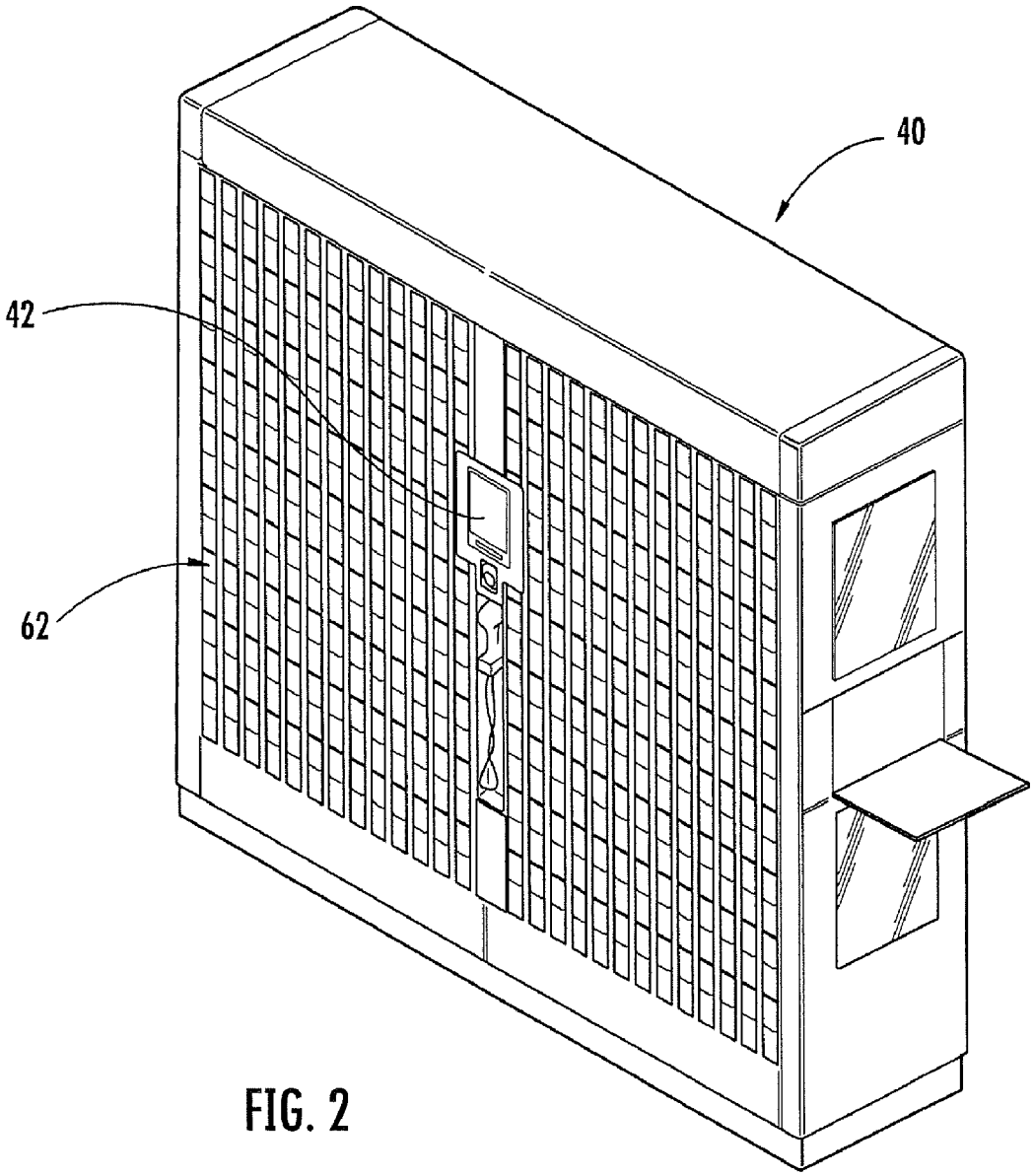
FIG. 2 is a front perspective view of an automated pharmacy machine according to embodiments of the present invention.
Figure 3:
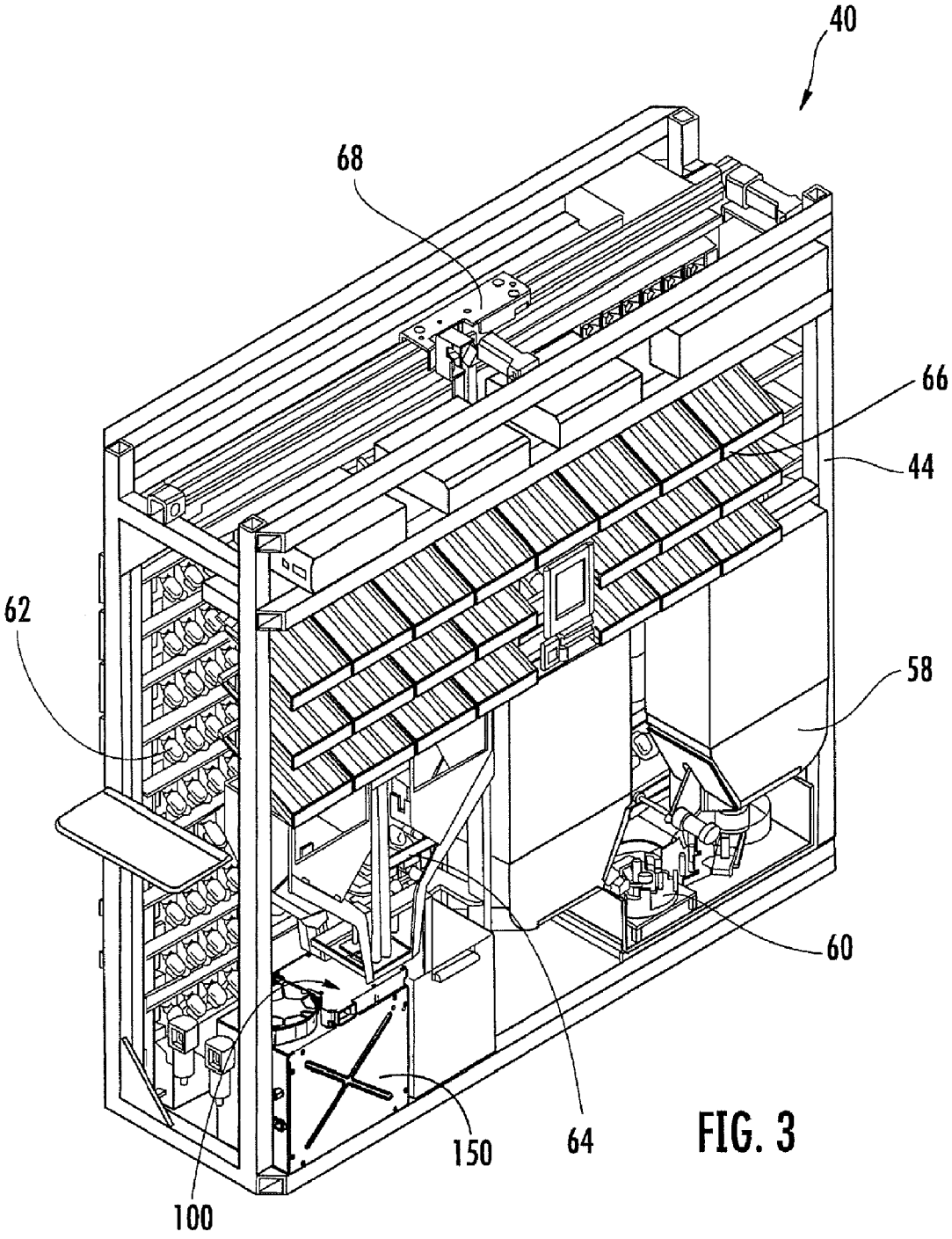
FIG. 3 is an opposite side front perspective view of the automated pharmacy machine of FIG. 2 with the outer skin removed to permit visual access to components housed therein.

A system that can carry out this process is illustrated in FIGS. 2 and 3 and designated broadly therein at 40. The system 40 includes a support frame 44 for the mounting of its various components. The system 40 generally includes as operative stations a controller (represented herein by a graphics user interface monitor 42), a container dispensing station 58, a labeling station 60, a tablet dispensing station 62, a closure station 64, and an offloading station 66. In the illustrated embodiment, containers, tablets and closures are moved between these stations with a single carrier 68; however, in some embodiments additional carriers may be employed. The operation of the container dispensing station 58, the labeling station 60, the tablet dispensing station 62, the closure station 64, and the offloading station 66 are described in, for example, U.S. patent application Ser. Nos. 11/599,526; 11/599,576; 11/679,850; 11/693,929; 11/755,249; 11/927,865; and 11/111,270, the disclosure of each of which is hereby incorporated herein in its entirety.

Figure 4:
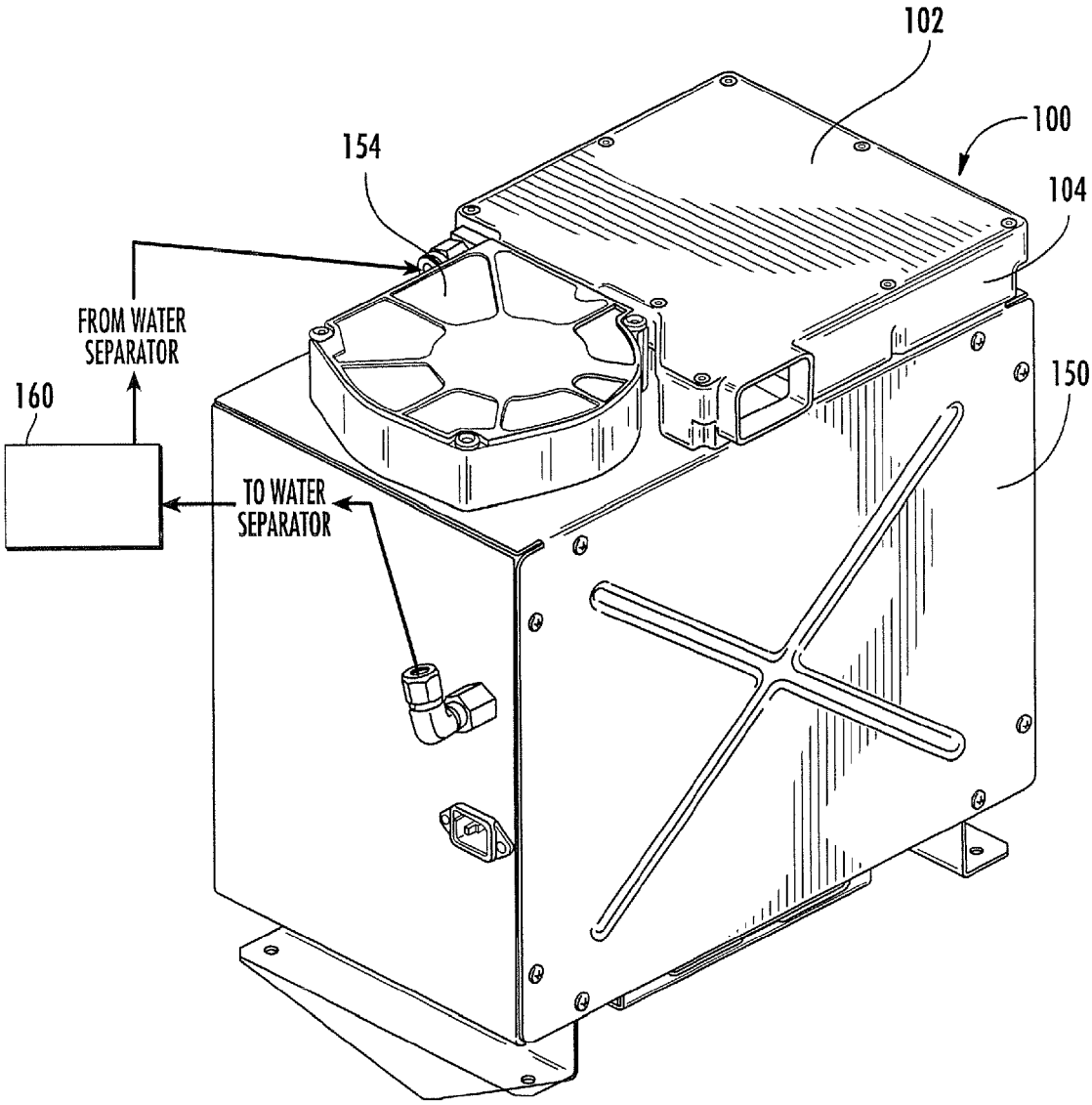
FIG. 4 is an enlarged perspective view of the compressor unit and evaporator system of the automated pharmacy machine of FIG. 2.

FIG. 4 is an enlarged view of a compressor unit 150 upon which is mounted an evaporator system 100. The compressor unit 150, which is mounted to the frame 44 (see FIG. 3), provides forced air to the system 40 for operation of, inter cilia, the tablet dispensing station 62. The compressor unit 150 includes a water separator 160 that receives the pressurized airstream (which includes liquefied water vapor) and extracts the water from the airstream. The water separator 160 is fluidly connected to the evaporation system 100 to provide the extracted water thereto and is also connected with a manifold of the tablet dispensing station 62 to provide the now-dry pressurized air thereto. The compressor unit 150 further includes a blower 154 on its top surface. The blower 154 receives heated ambient air generated by working components within the compressor unit 150 and supplies that heated air to the evaporator system 100.

Figure 5:
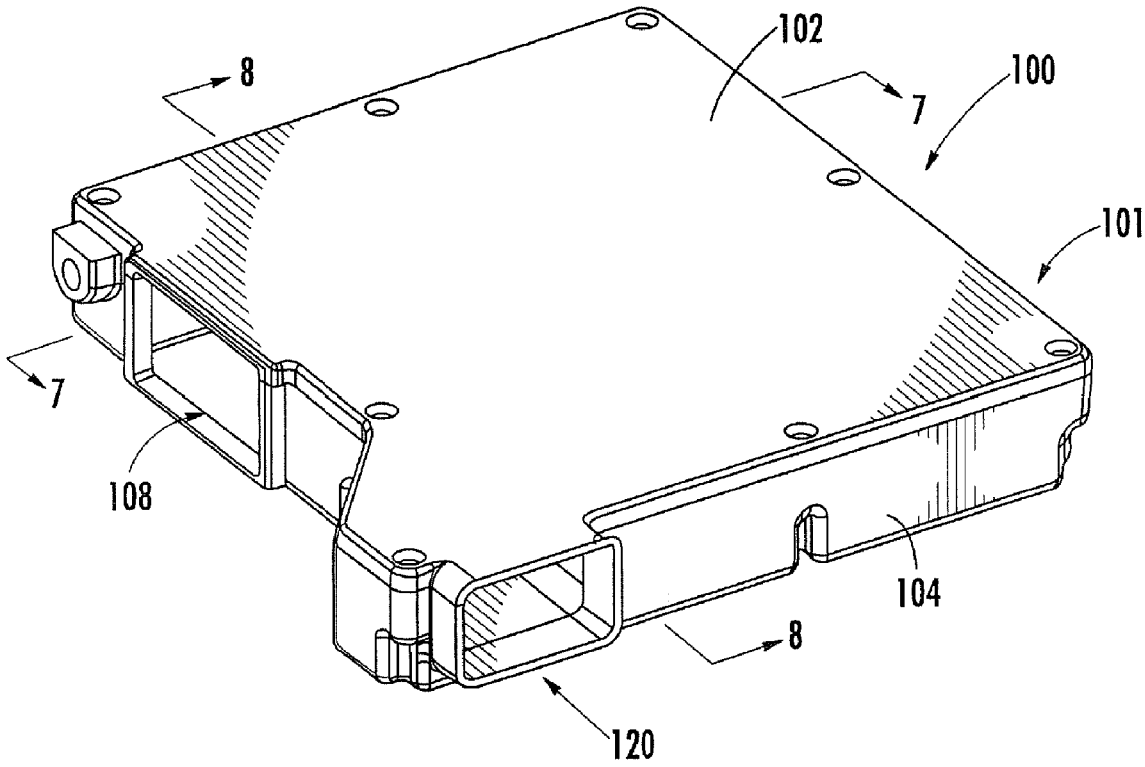
FIG. 5 is a perspective view of the evaporation system of the automated pharmacy machine of FIG. 2.

Turning now to FIGS. 3-5, the evaporator system 100 is shown therein. The evaporator system 100 comprises a housing 101 that includes a ceiling 102 and a lower half 104. These parts are described in greater detail below.

Figure 6:
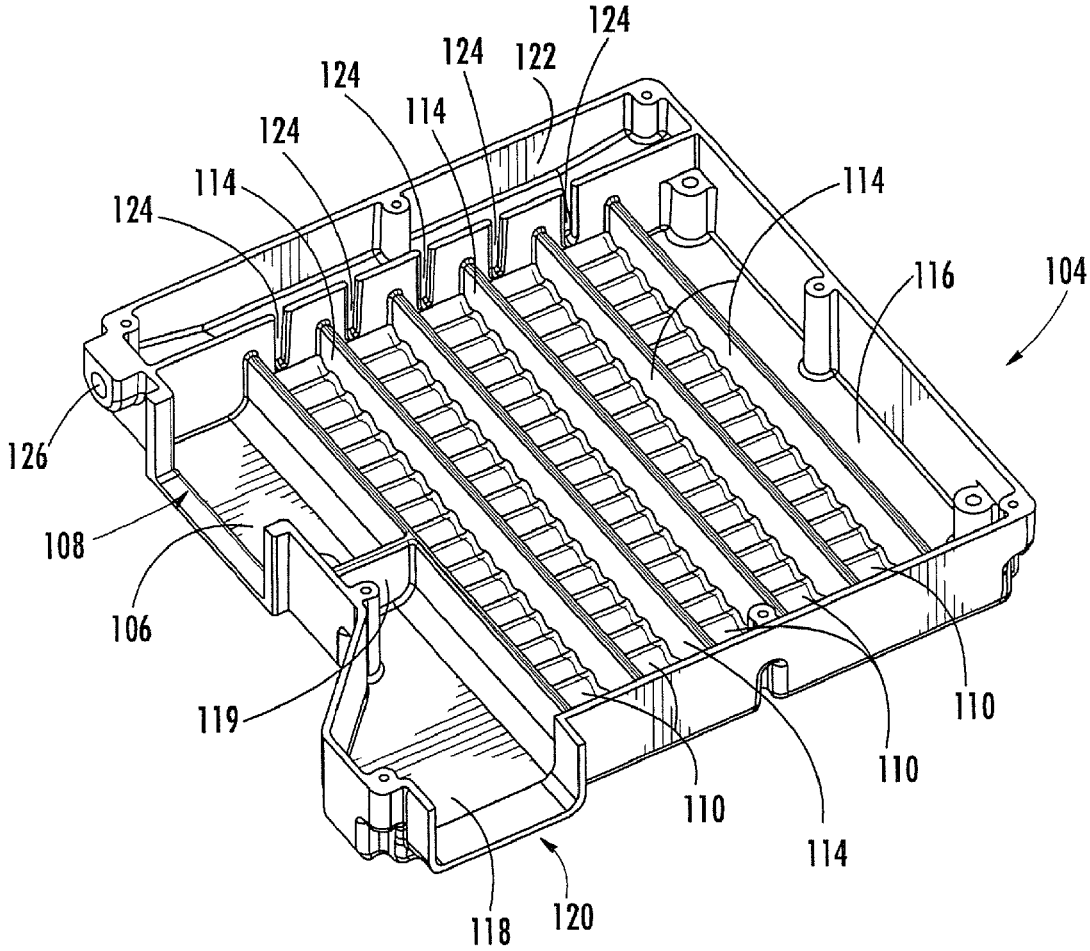
FIG. 6 is a perspective view of the lower half of the evaporation system of FIG. 5.

Turning now to FIG. 6, the lower half 104 includes an inlet area 106 having an opening 108. The opening 108 is configured to receive heated air from the blower 154 (see FIG. 4). Five channels 110 bounded on either side by dividers 114 are arranged to extend transversely across the lower half 104. A diverting section 116 is located opposite the inlet region 106. An air outlet region 118 is located adjacent the inlet region 106 (separated by a partition 119) and includes an opening 120 in fluid communication with the environment.

A water reservoir 122 is located on the side of the lower half 104 opposite the outlet region 118. The water reservoir 122 includes a water inlet 126 that is configured to receive water extracted from the compressor unit 150. The reservoir 122 is sloped upwardly at each end to encourage water to flow toward the center thereof. Feed slots 124 are located to provide fluid communication between the water reservoir 122 and each of the channels 110.

Figure 8:
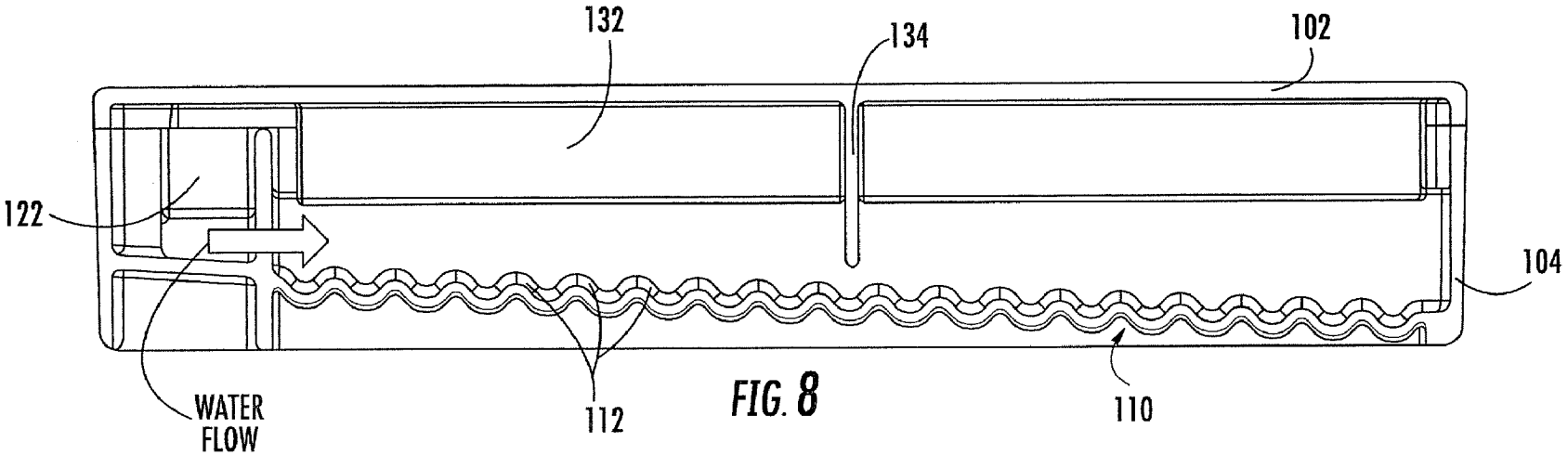
FIG. 8 is a section view taken along lines 8-8 of FIG. 5.

Turning now to FIG. 8, in which an exemplary channel 110 is illustrated, it can be seen that the channels 110 slope gently downwardly away from the water reservoir 122; typically, the angle of slope is between about 1 and 3 degrees. Each of the channels 110 includes a plurality of undulations 112 that extend transversely to the axes of the channels 110. The depth of the undulations 112 is typically between about ⅛ and ¼ inches. In some embodiments, the angle of the slope of the channels 110 and the depth of undulations 112 is selected so that the undulations 112 are "just filled" with water in order to increase evaporation efficiency.

In the illustrated embodiment, the lower half 104 is typically formed as an integral unit, but can be formed from multiple components. The lower half 104 may be formed of any suitable material, but is typically formed of an injection molded polymeric material, such as ABS. In some embodiments, the material may be treated with an antimicrobial agent to prevent mold growth.

Figure 7:
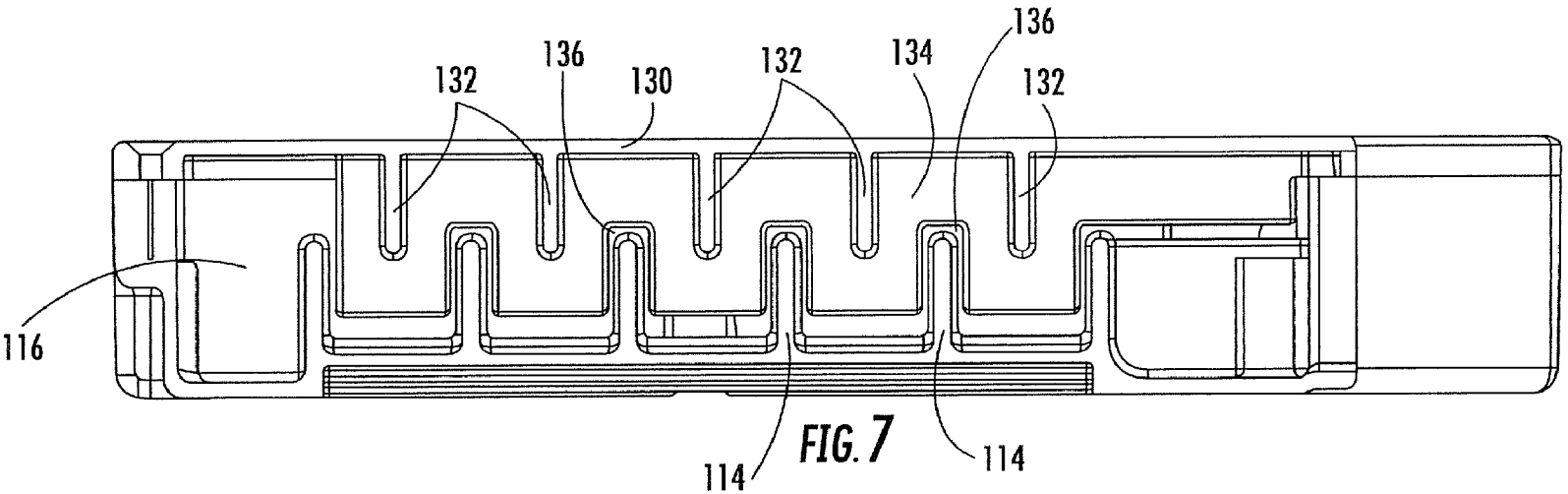
FIG. 7 is a section view taken along lines 7-7 of FIG. 5.
Figure 9:
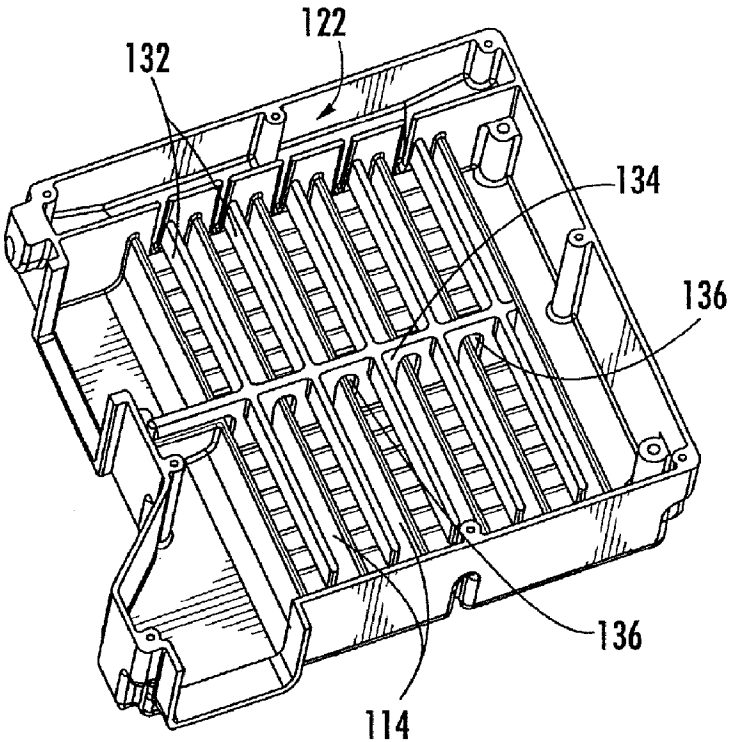
FIG. 9 is a cutaway perspective view of the evaporation system of FIG. 5 with the main panel of the ceiling removed.

Turning now to FIGS. 7 and 9, the ceiling 102 includes a main panel 130 and a number of walls 132 that depend therefrom. The walls 132 are positioned to be interdigitated and generally centered between the dividers 114 on either side of respective channels 110. As can be seen in FIG. 7, the result is a baffle-type structure created by the dividers 114 and the walls 132. The ceiling 102 also includes a bifurcating wall 134 that is perpendicular to the channels 110 and divides the channels 110 generally in half. Flow apertures 136 in the bifurcating wall 134 receive the dividers 114; the flow apertures 136 enable fluid to flow between the halves of individual channels 110.

In the illustrated embodiment, the ceiling 102 is typically formed as an integral unit, but can be formed from multiple components. The ceiling 102 may be formed of any suitable material, but is typically formed of an injection molded polymeric material, such as ABS.

As can be seen in FIG. 5, the evaporator assembly 100 is assembled with the ceiling 102 overlying the lower half 104 to form the enclosed housing 101. The assembled evaporator assembly 100 rests on the compressor unit 150 (FIGS. 3 and 4) in the illustrated embodiment, but can be positioned anywhere in the system 140. The blower 154 provides heated ambient air from the compressor unit 150 (which is produced by heat generated by the pressurizing components of the compressor unit 150) to the opening 108 of the inlet region 106, and a water line (not shown) is connected between the water separator 160 of the compressor unit 150 and the water inlet 126.

In operation, water separated from the pressurized air produced by the compressor unit 150 is routed from the water separator 160 to the water reservoir 122 through the water inlet 126. The shape of the reservoir 122 encourages the water to pool in the central portion of the reservoir 122. Water flows from there into the channels 110 through the feed slots 124. Individual undulations 112 trap some of the water, with the remainder of the water continuing to flow down the channels 110; if there is sufficient water present in a channel 110, it will flow through the flow apertures 136 to the downstream end of the channel 110 (see FIG. 8). The presence of the undulations can increase the evaporative surface area of the water compared to a simple sloping channel, thereby encouraging more rapid evaporation.

Figure 10:
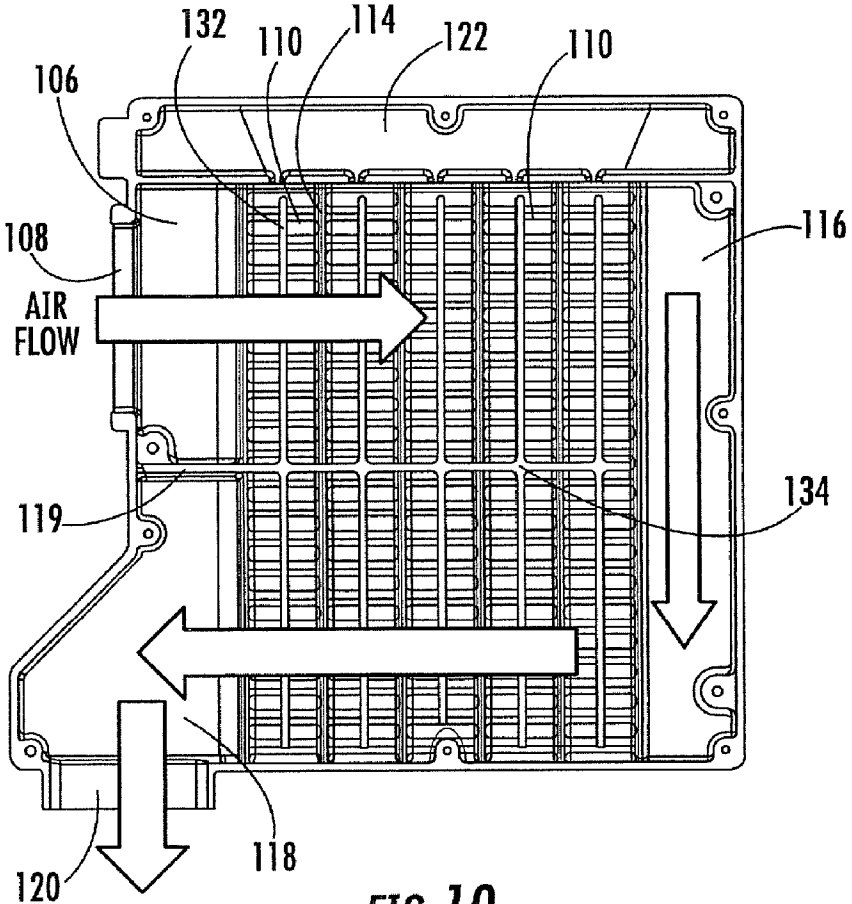
FIG. 10 is a cutaway top view of the evaporation system of FIG. 5 showing the direction of air flow.

High temperature ambient air from the blower 154 of the compressor unit 150 is directed into the opening 108 of the inlet region 106. In some embodiments, the temperature of the air is between about 120 and 140° F., and the flow rate is between about 20 and 30 cfm. As is shown in FIG. 10, this air flows from the inlet region 106 over the upstream halves of the channels 110 to the diverting section 116; however, the path followed by the air is a sinuous one, as the air must travel, in alternating fashion, over the dividers 114 and under the walls 132 of the ceiling 102 (see FIG. 7). The "baffles" created by the dividers 114 and walls 132 creates turbulence in the air flow, which turbulence can increase evaporation by "sloshing" the water present in the undulations 112.

As can be seen in FIG. 10, once the air flow reaches the diverting section 116, it veers sideways, then travels over the downstream halves of the channels 110 to the outlet region 118. The air, by then laden with some of the water that has evaporated from the channels 110, flows out of the opening 120 and into the atmosphere.

Those skilled in this art will appreciate that the evaporator system 100 may take other forms. For example, more or fewer channels 110 may be present. The undulations may be shaped differently (for example, they may have a square wave or sawtoothed configuration), they may be oriented perpendicular to or at an oblique angle relative to the direction of air flow, or they may be omitted entirely. The channels may be sloped more or less gently, or may be level. Also, more or fewer walls depending from the ceiling (that form the baffles) may be present, or they may be omitted entirely. The dividing wall and/or partition may be omitted. Other possible variations will be recognized by those skilled in this art.

In addition, the direction of air flow may be oriented at an oblique angle or parallel with the channels. Also, the air flow may be directed only in one direction (such that the air inlet and outlet are on opposed ends of the housing), or it may be redirected multiple times across the series of channels. The air may be supplied from a source other than a compressor, as may the water to be evaporated.

Further, the evaporator system is not limited to use in an automated pharmaceutical dispensing machine; any device or apparatus that uses a compressor unit or otherwise generates undesirable condensation may be suitable for use with an evaporation system according to embodiments of the invention.

The foregoing is illustrative of the present invention and is not to be construed as limiting thereof. Although exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention as defined in the claims. The invention is defined by the following claims, with equivalents of the claims to be included therein.

That which is claimed is:

1. An automated pharmacy machine, comprising:

a container dispensing station;

a container labeling station;

a tablet dispensing station, the tablet dispensing station being configured to utilize compressed air provided by a compressor unit;

a carrier configured to move a container between the container dispensing station, the container labeling station, and the tablet dispensing station; and an evaporation system, the evaporation system configured to receive ambient air and water from the compressor unit, the water being extracted from pressurized air produced by the compressor unit, and to evaporate the water utilizing the ambient air.

2. The automated pharmacy machine defined in claim 1, further comprising a water separator that receives pressurized air from the compressor unit and provides water to the evaporation system.

3. The automated pharmacy system defined in claim 1, wherein the compressor unit comprises a blower that provides ambient air from the compressor unit to the evaporation system.

4. The automated pharmacy machine defined in claim 1, wherein the evaporation system comprises a housing having:

an air inlet, the air inlet directing air in a first direction;

an air outlet;

a plurality of channels arranged generally perpendicular to the first direction, the channels having undulations; and a water reservoir that feeds water into the channels.

5. The automated pharmacy machine defined in claim 4, wherein the channels slope downwardly away from the water reservoir.

6. The automated pharmacy machine defined in claim 4, wherein the channels are separated from each other by dividers that extend generally parallel to the channels.

7. The automated pharmacy machine defined in claim 6, wherein the housing includes a ceiling with walls depending therefrom.

8. The automated pharmacy machine defined in claim 7, wherein each of the ceiling walls is located directly above a respective channel, such that the ceiling walls are interdigitated with the dividers.

9. The automated pharmacy machine defined in claim 4, wherein the evaporation system further comprises a diverting section opposite the air inlet that reverses the direction of air flow to a second direction that is opposite the first direction.

10. The automated pharmacy machine defined in claim 9, further comprising a bifurcating wall generally parallel to the first and second directions that forces air to travel in the first direction from the air inlet to the diverting section and in the second direction from the diverting section toward the air outlet.

11. The automated pharmacy machine defined in claim 10, wherein the bifurcating wall includes flow apertures to allow water to flow from an upstream end of one of the plurality of channels to a downstream end of the channel.

12. The automated pharmacy machine defined in claim 4, wherein the undulations are between about ⅛ and ¼ inches in depth.

13. The automated pharmacy machine defined in claim 1, further comprising a capping station.

14. An automated pharmacy machine, comprising:

a container dispensing station;

a container labeling station;

a tablet dispensing station, the tablet dispensing station being configured to utilize compressed air provided by a compressor unit;

a carrier configured to move a container between the container dispensing station, the container labeling station, and the tablet dispensing station;

an evaporation system, the evaporation system configured to receive ambient air and water from the compressor unit, the water being extracted from pressurized air produced by the compressor unit, and to evaporate the water utilizing the ambient air; and a water separator that receives pressurized air from the compressor unit and provides water to the evaporation system;

wherein the compressor unit comprises a blower that provides ambient air from the compressor unit to the evaporation system.

15. The automated pharmacy machine defined in claim 14, wherein the evaporation system comprises a housing having:

an air inlet, the air inlet directing air in a first direction;

an air outlet;

a plurality of channels arranged generally perpendicular to the first direction, the channels having undulations; and a water reservoir that feeds water into the channels.

16. The automated pharmacy machine defined in claim 14, further comprising a capping station.

* * * * *